US005650010A

United States Patent [19]

Rantanen et al.

[11] Patent Number: 5,650,010

[45] Date of Patent: Jul. 22, 1997

[54] APPARATUS FOR TWO-SIDE COATING OF A THIN PRINTING PAPER WEB CONTAINING MECHANICAL PULP OR RECYCLED FIBER

[75] Inventors: Rauno Rantanen, Muurame; Kai Vikman, Kirkniemi, both of Finland

[73] Assignee: Valmet Corporation, Helsinki, Finland

[21] Appl. No.: 573,570

[22] Filed: Dec. 15, 1995

Related U.S. Application Data

[63] Continuation of Ser. No. 132,037, Oct. 5, 1993, abandoned.

[30] Foreign Application Priority Data

Nov. 3, 1992 [FI] Finland ..... 924960

[51] Int. Cl.[6] ..... B05C 1/00

[52] U.S. Cl. ..... 118/224; 118/58; 118/67; 118/126; 118/203; 118/249; 118/255; 118/643

[58] Field of Search ..... 118/58, 60, 66, 118/67, 70, 101, 104, 117, 119, 122, 126, 203, 216, 224, 249, 255, 643, 410, 413; 34/125; 427/361, 428, 211

[56] References Cited

U.S. PATENT DOCUMENTS

| | | | |
|---|---|---|---|
| 1,536,479 | 5/1925 | Cumfer | 34/125 |
| 3,034,926 | 5/1962 | Carter et al. | 118/643 |
| 3,242,583 | 3/1966 | Calkins | 34/125 |
| 3,811,821 | 5/1974 | Ariyama et al. | 118/70 |
| 3,874,331 | 4/1975 | Kirsen | 118/262 |
| 3,895,603 | 7/1975 | Barouh et al. | 118/643 |
| 3,897,576 | 7/1975 | Qualtrough et al. | 427/211 |
| 3,982,056 | 9/1976 | Holder, Jr. | 427/361 |
| 4,122,218 | 10/1978 | Bostrüm et al. | 118/64 |
| 4,407,867 | 10/1983 | Brück et al. | 118/249 |
| 4,478,887 | 10/1984 | Sommer et al. | 427/211 |
| 4,839,201 | 6/1989 | Rantanen et al. | 118/410 |
| 4,961,964 | 10/1990 | Dahlgren | 427/211 |
| 4,965,920 | 10/1990 | Smith | 34/125 |
| 5,003,915 | 4/1991 | D'Amato et al. | 118/216 |
| 5,033,373 | 7/1991 | Brendel et al. | 427/361 |
| 5,133,279 | 7/1992 | Dudde et al. | 118/60 |
| 5,310,573 | 5/1994 | Tanokuchi et al. | 118/249 |

FOREIGN PATENT DOCUMENTS

| | | | |
|---|---|---|---|
| 552427 | 1/1958 | Canada | 34/125 |

*Primary Examiner*—Laura Edwards

*Attorney, Agent, or Firm*—Cohen, Pontani, Lieberman, Pavane

[57] ABSTRACT

A method and apparatus for two-side coating of a light base weight printing paper web containing mechanical pulp or recycled fiber. The first side of a web (5) is coated in a first coating station (1), the coating applied to the first side is dried at least partially in a first dryer unit (3). The second side of the web (5) is coated subsequent to the drying of the first side in a second coating station (2), and the coating applied to the second side is dried at least partially in a second dryer unit (4). Both coatings are formed by applying a required amount of coating mix onto the perimeter of respective soft film-coating rolls (22) and subsequently transferring the coat film to the web (5) in a nip ($N_1$) formed between a respective backing roll (24) and the respective soft film-coating roll (22).

22 Claims, 2 Drawing Sheets

APPARATUS FOR TWO-SIDE COATING OF A THIN PRINTING PAPER WEB CONTAINING MECHANICAL PULP OR RECYCLED FIBER

FIELD OF THE INVENTION

This is a continuation, of application Ser. No. 08/132,037, filed Oct. 5, 1993 now abandoned.

The present invention relates to a method for two-side coating of a thin printing paper web containing mechanical pulp, e.g., a paper web made of recycled fiber.

The invention further relates to an apparatus suited to two-side coating of a thin printing paper web made of mechanical pulp.

BACKGROUND OF THE INVENTION

Thin printing paper webs containing mechanical pulp are conventionally coated on subsequent coating stations equipped with short-dwell coaters as the coater units. A combination of two subsequent coater stations is necessary as low base paper weight and high content of ground wood make single-run coating on both sides impossible. Two-side coating with conventional methods would excessively wet the web and thus impair its runnability. Furthermore, the measurement of coat weight in a two-side coating operation is difficult.

Despite their multiple benefits, short-dwell coaters also have several drawbacks. Air entrapped in the coat paste easily causes mottling. Because of the small linear application pressure and short application distance, wetting of the base web and subsequent fiber swelling occurs even after the web has passed the doctor blade, thereby impairing the smoothness of the coat being applied. As a rule, doctor blade coating methods become critical with thin webs and particularly with light coat weights.

Paper grades containing a high proportion of mechanical pulp and a high percentage of coat fillers such as, e.g., SC paper (wood containing high filler content super-calendared printing paper) make doctor blade coating impossible because of the fragility of the base paper web.

Web defects leading to brittleness result in low production yield and inferior runnability.

Base paper grades containing recycled fiber have posed unexpected problems in doctor blade coaters, specifically, the coat is easily marked during coating by streaks caused by defective doctor blades.

The darker color of recycled-fiber containing base paper grades make the opacifying power of the coat mix more critical. Because of the way in which doctor blade coating is accomplished, a smooth coat is formed, not a coat of uniform coat weight. As the base paper is not necessarily smooth, the opacifying power obtained in doctor blade coating is insufficient, resulting in mottling of the coated web.

SUMMARY OF THE INVENTION

It is an object of the present invention to overcome the disadvantages of the above-described prior-art technology and to achieve an entirely novel method and apparatus for two-side coating of a thin printing paper web containing mechanical pulp such as, for example, a paper web grade made of recycled fiber.

The present invention is based on performing the coating operation using a two-step compressive film-lamination technique.

The present invention relates a method and apparatus in which a coating is applied onto both sides of a light base weight printing paper web containing mechanical pulp or recycled fiber in which one side of the web is coated in a first coating station and then dried, at least partially, in a first dryer unit, and then the second side of the web is coated in a second coating station and then dried, at least partially, in a second dryer unit. Both of the two coating layers are formed by applying the required amount of a coating mix onto the perimeter of respective soft film-coating rolls which rotate with a peripheral speed approximately equally to the speed of the paper web. The coating mix is subsequently transferred to the paper web in a nip formed between a respective backing roll and the respective soft film-coating rolls.

The invention provides significant benefits. The present invention cuts in half the amount that a web is wetted in comparison to single-run two-side coating. Thus, the present invention provides good runnability. Further, good coat quality is attained at light coat weights. Particular benefit is achieved with base paper grades containing recycled fibers because the formation of streaks associated with doctor blade coating can be avoided. Since the compressive film-lamination technique forms a coat of uniform weight on the web, the coat has high opacifying power. For the same reason, a higher burst index relative to doctor blade coating is attained. Moreover, the measurement of coat weight by means of rupturing testers is easy. The present invention imposes minimal mechanical stress on the web. While two-side single-run coating requires a long path of unsupported pulling of the web prior to the web support roll to give the coat a possibility of drying prior to touching the support roll, according to the present invention, the uncoated side can be supported by a roll immediately after the coating of the other side, thus achieving a significant reduction in coat unit size.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

DETAILED DESCRIPTION OF THE PREFERRED EMBODIMENTS

In conjunction with the present invention, the term compressive film-lamination technique is used to refer to a technique in which during coating the web is subjected to a linear pressure in a nip formed between a film-coating roll and a backing roll so that the peripheral speeds of both the film-coating roll and the backing roll are approximately equal to the web speed.

In conjunction with the present invention, the term light web material refers to web materials having a base weight of less than 65 g/m$^2$.

Figure 1:
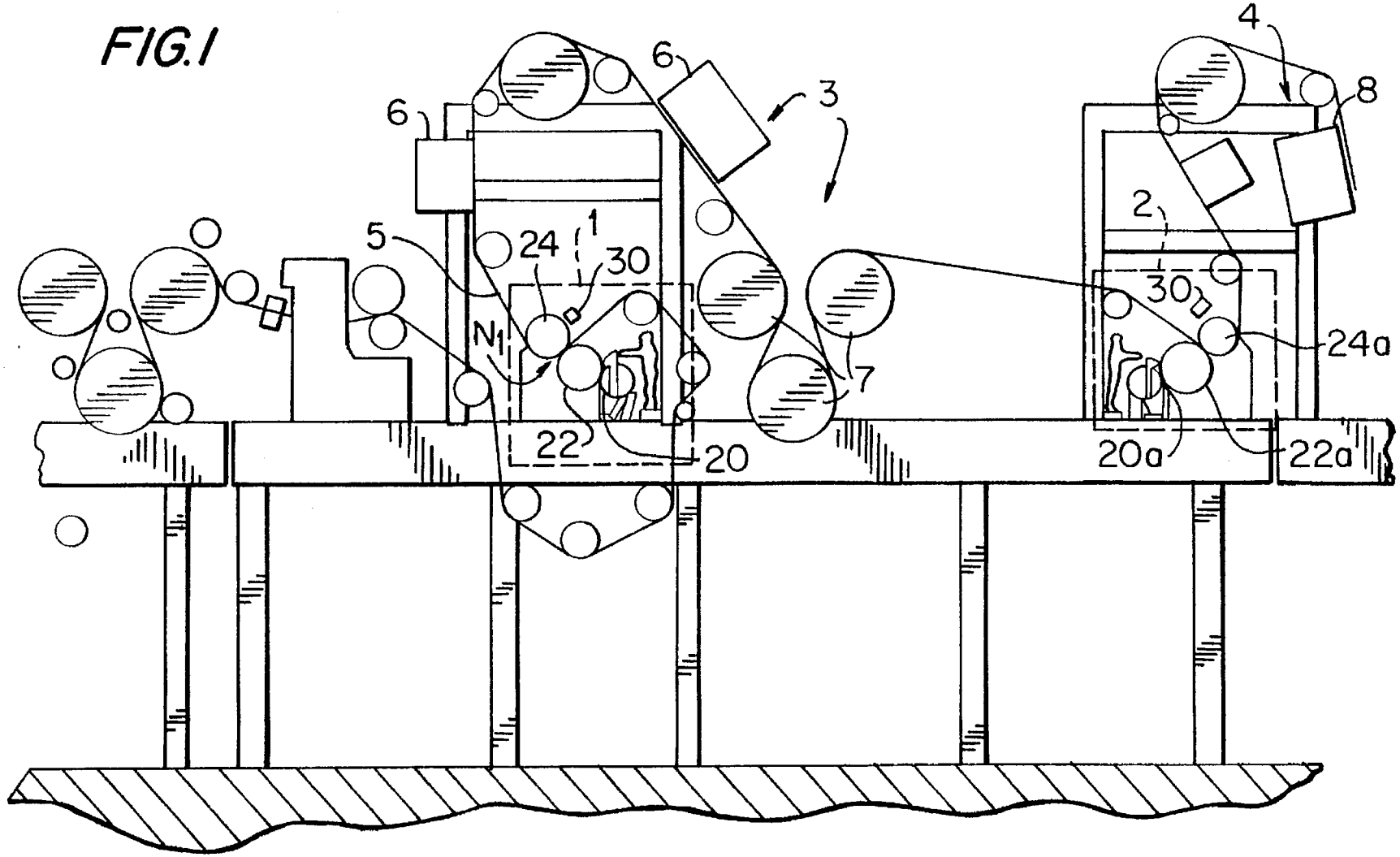
FIG. 1 is a side elevation view of a part of a paper machine incorporating a coater according to the present invention.

With reference to FIG. 1, the apparatus according to the present invention comprises two compressive film-lamination stations: a first coating station 1 and a second coating station 2. A first drying unit 3 is placed between the two coating stations. The path of web 5 is configured so that subsequent to the first drying unit 3 there is the second coating station 2, followed by a second drying unit 4. Basically, both drying units have a similar construction. The first coating station 1 is comprised of a film-coating roll 22, a coater bar 20 and a backing roll 24 of the film coating roll 22. The coater bar 20 meters a desired amount of coating mix onto the film-coating roll 22, wherefrom the coating mix is subsequently transferred in the nip $N_1$ to the web 5. To make the coating mix adhere to the web with the greatest smoothness without exhibiting a peeling off effect, such as, for example, when an orange is peeled, the backing roll 24 has advantageously a smaller diameter than the film-coating roll, whereby the angle at which the web 5 conforming to the backing roll 24 exits the nip $N_1$ is maximized. In an alternative embodiment the web 5 is guided toward the film-coating roll 22, whereby also a good coat surface quality is obtained.

The first drying unit 3 is comprised of infra-red dryers 6 and dryer drums 7.

Basically, the second coating station 2 has a similar construction to that of the first coating station 1 and components common to both coating stations have the same reference numerals distinguished by the letter "a". Because of the routing of the web 5, the first station 1 is a mirror image of second coating station 2. The second coating station 2 is analogously followed by the second drying unit 4 comprising an infra-red dryer 8 with subsequent drying cylinders (not shown).

Figure 2:
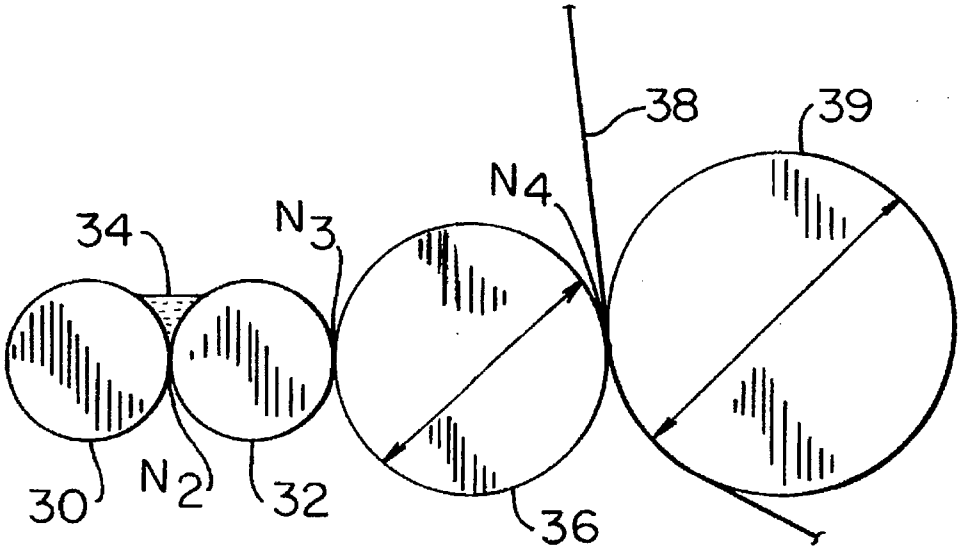
FIG. 2 is a side view of an alternative embodiment of the coating step of the present invention.

With reference to the embodiment of the present invention shown in FIG. 2, the coating bar 20 can be replaced by a so-called gate roll coater in which the coating mix is transferred from a coating mix fountain 34 located above a nip $N_2$, which is formed by a transfer roll 30 and a metering roll 32, via the nip $N_2$ onto the perimeter of said metering roll 32 and further via a nip $N_3$ onto the perimeter of a film-coating roll 36. From the perimeter of the film-coating roll 36, the coating mix is applied to a web 38 in a nip $N_4$ formed between the film-coating roll 36 and a backing roll 39. According to the present invention, the diameter of the backing roll 39 can be smaller than the diameter of the film-coating roll 36.

Typically the film-coating roll 36 has a diameter of 1000 mm and the backing roll 39 has a diameter of 800 mm.

Characterizingly, in both of the above-described exemplifying embodiments of the present invention the surface of the film-coating roll 22, 36 is adjusted to carry a film of the coating mix of approximately 7 to 15 μm in thickness, a major portion (typically approximately 80%) of which is adhered to the web in the nip between the film-coating roll and the backing roll. Thus, the web is coated with a coat of 7 to 15 g/m$^2$ dry weight.

The adsorption of the coating mix paste and the water contained therein is related to the magnitude of the nip pressure and the duration of said pressure, that is, the width of the nip. On the other hand, the nip width is solely determined by the diameters of the rolls and their hardness, while the magnitude of the nip pressure is principally determined by the linear loading of the nip, and additionally, by the web speed. Accordingly, good penetration of the coat into the web is achieved by means of a high linear application pressure imposed in a relatively wide nip.

The maximum nip pressure typically is 1000 kPa gauge and the nip width is in excess of 15 mm. Good results according to the present invention have been obtained by keeping the nip pressure above 500 kPa and the nip width greater than 10 min. Such desirable nip widths can be attained by means of hard rolls with diameters in excess of 600 mm. Particularly the film-coating roll must have a diameter greater than 600 mm, whereby the backing roll must also have a diameter in excess of 600 mm. To achieve the minimum pressure limit of 500 kPa, the linear nip loading must be at least 20 kN/m for typical coating mix paste. In conventional kiss roll coating, the application pressure is only approximately 50 to 100 kPa, while a conventional doctor blade coater can achieve a pressure of 1000 kPa over a nip width of less than 1 mm. In a conventional short-dwell coater the encountered levels of application pressure are even lower. The technique according to the invention is typically suitable for web speeds of 400 to 1500 m/min. The linear nip loading is typically in the range of 20 to 50 kN/m, advantageously approximately 35 kN/m. The coating material of both the backing roll 39 and the film-coating roll 36 is polyurethane, rubber or any suitable resilient material. The P & J numbers of the rolls are typically in the range of approximately 0 to 40. The film-coating roll employed in the embodiments according to the invention is invariably a so-called soft roll with a surface material of polyurethane, for instance.

Figure 3:
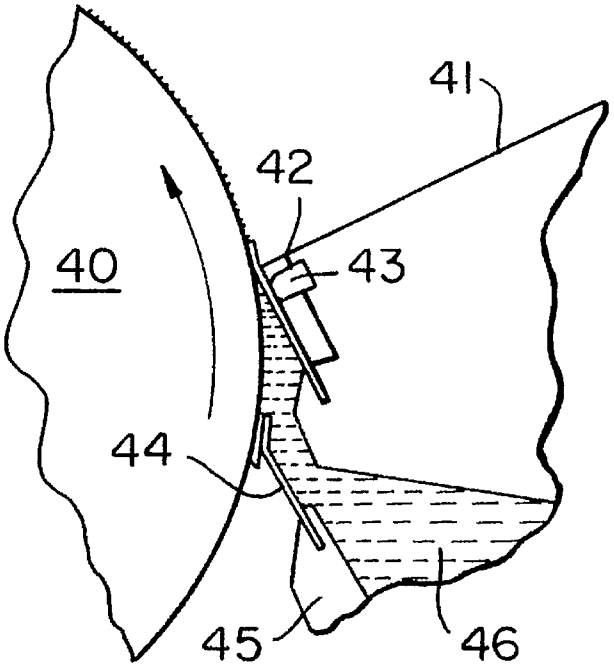
FIG. 3 is a side view of a detail of a nozzle assembly according to the present invention.

With reference to FIG. 3, a nozzle assembly for a film-coating roll 40 is comprised of a coater blade 42 tilted to an acute angle and mounted to a frame structure 41. Between the frame structure 41 and the blade 42 is placed a loading hose 43 suited to controlling the linear pressure and position of the coater blade 42. The coating mix 46 is contained in a metering fountain formed between a front wall 44 and the coater blade 42, wherefrom the mix is transferred in a controlled manner onto the perimeter of the coating roll 40. The front wall 44 is mounted by means of support elements 45 onto the chassis of the apparatus. Such a nozzle assembly is known in the art and its construction is described, for example, in greater detail in U.S. Pat. No. 4,839,201 which is incorporated herein by reference. The coater blade 42 can alternatively be replaced by a doctoring bar.

In a preferred embodiment of the present invention, the backing roll has a metal surface. The metal surface can be of chromium, for instance. Also ceramic or polymer covered backing rolls are usable. A metal or ceramic covered backing roll performs initial calendaring of the coated web. Such coated rolls with a steel core can also be chilled, whereby condensation of moisture on to the roll perimeter is attained, which in turn aids keeping the roll clean. Because of the improved thermal and wear resistance of a metal or ceramic covered roll, steam cleaning means and scraper blades, shown schematically in FIG. 1 with a common reference numeral 30, can also be used for keeping the rolls clean.

According to the present invention, the nozzle assembly employed for metering the coating mix onto the film-coating roll can also be a slot-orifice die metering assembly or a spraying apparatus capable of spraying the coating mix onto the roll surface.

The table below gives exemplifying compositions of coating mixes suitable for advantageous use according to the present invention:

| Coating color component | Coating mix composition 1 | Coating mix composition 2 |
|---|---|---|
| Calcium carbonate pigment | 100 parts | |
| Kaolin pigment | | 100 parts |
| Starch binder | 10 parts | 6 parts |
| Synthetic binder | 4 parts | 6 parts |
| Additives | 2 parts | 0.5 parts |
| Solids content | 55% | 58% |
| Viscosity (Brookfield 100) | 500 cP | 800 cP |

Thus, while there have been shown and described and pointed out fundamental novel features of the invention as applied to a preferred embodiment thereof, it will be understood that various omissions and substitutions and changes in the form and details of the disclosed apparatus, and in its operation, may be made by those skilled in the art without departing from the spirit of the invention. It is the intention, therefore, to be limited only as indicated by the scope of the claims appended hereto.

What is claimed is:

1. An apparatus for two-side coating of a printing paper web containing mechanical pulp or recycled fiber and having a base weight of less than 65 g/m$^2$ comprising:

a. a first coating station (1) in which a desired amount of a water containing coating mix is pressed onto only a first side of the web (5), said first coating station (1) comprising:

i. a first resilient film-coating roll (22) suitable for receiving onto a perimeter the desired amount of the coating mix, suitable for rotating at a peripheral speed approximately equal to a speed in which the web (5) travels, and suitable for transferring the coating mix to the web (5);

ii. a first coating mix application means (20) for metering the coating mix onto the perimeter of said first film-coating roll (22); and iii. a first backing roll (24) capable of forming a first nip ($N_1$) between said first backing roll (24) and said first film-coating roll (22), said first backing roll (24) suitable for rotating at a peripheral speed approximately equal to a speed in which the web (5) travels, said web (5) being routed through the first nip ($N_1$) whereby the coating mix is pressed onto only the first side of the web, said first backing roll (24) in conjunction with said first film-coating roll (22) calendaring the web (5);

b. a first dryer unit (3) arranged so as to dry the web (5) as the web leaves the first coating station;

c. a second coating station (2) in which a desired amount of a water containing coating mix is pressed onto only a second side of the web (5), said second coating station (2) being arranged downstream of the first dryer unit and comprising:

i. a second resilient film-coating roll suitable for receiving onto a perimeter the desired amount of the coating mix, suitable for rotating at a peripheral speed approximately equal to a speed in which the web (5) travels, and suitable for transferring the coating mix to the web (5);

ii. a second coating mix application means for metering the coating mix onto the perimeter of said second film-coating roll; and iii. a second backing roll capable of forming a second nip between said second backing roll and said second film-coating roll, said second backing roll suitable for rotating at a peripheral speed approximately equal to a speed in which the web (5) travels, said web (5) being routed through the second nip whereby the coating mix is pressed onto only the second side of the web, said second backing roll in conjunction with said second film-coating roll calendaring the web; and d. a second dryer unit (4) arranged so as to dry the web (5) as the web leaves the second coating station.

2. The apparatus of claim 1, wherein said backing rolls are metal-covered.

3. The apparatus of claim 1, wherein said backing rolls are ceramic-covered.

4. The apparatus of claim 1, wherein said backing rolls are polymer-covered.

5. The apparatus of claim 1, wherein said backing rolls are chilled.

6. The apparatus of claim 1, further comprising steam cleaning means disposed at said backing rolls for steam cleaning said backing rolls.

7. The apparatus of claim 1, further comprising scraper cleaning means disposed at said backing rolls for scrape cleaning said backing rolls.

8. The apparatus of claim 1, wherein said first film-coating roll is positioned relative to said first backing roll, and said second film-coating roll is positioned relative to said second backing roll so as to permit coating a web having a base weight of less than 65 g/m$^2$.

9. The apparatus of claim 8, wherein said first and second coating mix application means comprise a nozzle.

10. The apparatus of claim 9, wherein said first and second coating mix application means are capable of metering coating mix of a viscosity of at least 500 cP onto the perimeter of said first and second film-coating rolls, respectively.

11. The apparatus of claim 10, wherein said first and second backing rolls are capable of pressing the coating mix onto the web with a nip pressure of at least 500 kPa.

12. The apparatus of claim 10, wherein said first and second film-coating rolls and said first and second backing rolls have diameters greater than 600 mm.

13. The apparatus of claim 11, wherein said first and second film-coating rolls and said first and second backing rolls have diameters greater than 600 mm.

14. The apparatus of claim 9, wherein said first and second backing rolls are capable of pressing the coating mix onto the web with a nip pressure of at least 500 kPa.

15. The apparatus of claim 9, wherein said first and second film-coating rolls and said first and second backing rolls have diameters greater than 600 mm.

16. The apparatus of claim 1, wherein said first and second coating mix application means comprise a nozzle.

17. The apparatus of claim 16, wherein said first and second coating mix application means are capable of metering coating mix of a viscosity of at least 500 cP onto the perimeter of said first and second film-coating rolls, respectively.

18. The apparatus of claim 16, wherein said first and second backing rolls are capable of pressing the coating mix onto the web with a nip pressure of at least 500 kPa.

19. The apparatus of claim 16, wherein said first and second film-coating rolls and said first and second backing rolls have diameters greater than 600 mm.

20. The apparatus of claim 1, wherein said first and second coating mix application means are capable of metering coating mix of a viscosity of at least 500 cP onto the perimeter of said first and second film-coating rolls, respectively.

21. The apparatus of claim 1, wherein said first and second backing rolls are capable of pressing the coating mix onto the web with a nip pressure of at least 500 kPa.

22. The apparatus of claim 1, wherein said first and second film-coating rolls and said first and second backing rolls have diameters greater than 600 mm.

* * * * *

UNITED STATES PATENT AND TRADEMARK OFFICE
CERTIFICATE OF CORRECTION

PATENT NO. : 5,650,010

DATED : July 22, 1997

INVENTOR(S) : Rantanen et al.

It is certified that error appears in the above-identified patent and that said Letters Patent is hereby corrected as shown below:

On the face of the patent the assignees of interest should read:

Valmet Corporation, Helsinki, Finland;
Metsä-Serla Paperi Ja Kartonki Oy, Kirkniemi, Finland.

Signed and Sealed this

Nineteenth Day of May, 1998

*Attest:*

*Attesting Officer*

BRUCE LEHMAN

*Commissioner of Patents and Trademarks*